US008532325B2

(12) United States Patent
Tung et al.

(10) Patent No.: US 8,532,325 B2
(45) Date of Patent: Sep. 10, 2013

(54) EARPHONE DEVICE WITH BASS ADJUSTING FUNCTION

(75) Inventors: Chiu-Yun Tung, Taichung (TW); Fang-Chang Hsieh, Taichung (TW); Yuan-Hsing Wu, Taichung (TW); Chung-Yi Huang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 510 days.

(21) Appl. No.: 12/897,225

(22) Filed: Oct. 4, 2010

(65) Prior Publication Data

US 2011/0081034 A1 Apr. 7, 2011

(30) Foreign Application Priority Data

Oct. 5, 2009 (TW) ..... 98133664 A

(51) Int. Cl.
*H04R 25/00* (2006.01)

(52) U.S. Cl.
USPC ..... 381/380; 381/338; 381/382

(58) Field of Classification Search
USPC ..... 381/322, 328, 338, 345, 349, 370, 381/371, 372, 373, 374, 380, 382; 181/129, 181/130, 135, 155, 156, 160
See application file for complete search history.

(56) References Cited

U.S. PATENT DOCUMENTS

| | | | | |
|---|---|---|---|---|
| 4,742,887 | A * | 5/1988 | Yamagishi | 181/129 |
| 7,391,878 | B2 * | 6/2008 | Liao | 381/370 |
| 8,422,717 | B2 * | 4/2013 | Lin et al. | 381/372 |

* cited by examiner

*Primary Examiner* — Huyen Le
(74) *Attorney, Agent, or Firm* — Muncy, Geissler, Olds & Lowe, PLLC

(57) ABSTRACT

An earphone device with a bass adjusting function is provided. The earphone device includes an accommodating portion and an extension segment. The accommodating portion has an inner chamber for accommodating a speaker. The extension segment which is hollow-shaped and has a first space and a second space therein, and the first space is in communication with the inner chamber of the accommodating portion, and when a portion of the extension segment is adjusted from a first position to a second position, the first space, the second space, and the inner chamber of the accommodating portion are in communication, so as to increase a volume of the back chamber of the speaker.

16 Claims, 9 Drawing Sheets

EARPHONE DEVICE WITH BASS ADJUSTING FUNCTION

CROSS-REFERENCE TO RELATED APPLICATION

This application claims the benefit of Taiwan Patent Application No. 098133664, filed on Oct. 5, 2009, which is hereby incorporated by reference for all purposes as if fully set forth herein.

BACKGROUND OF THE INVENTION

1. Field of Invention

The present invention relates to an earphone device, and more particularly to an earphone device having different bass performances by adjusting a volume of a back chamber of a speaker.

2. Related Art

FIG. 1 shows an earphone device according to the prior art. As shown in FIG. 1, the earphone device includes a case 10 having an accommodating portion 11. The accommodating portion 11 includes an inner chamber for accommodating components such as a speaker and a drive circuit. A bass tube 12 extends from the accommodating portion 11 of the case 10. When the speaker is disposed in the accommodating portion 11, the inner chamber is in communication with a space in the extended bass tube 12, so as to form a back chamber of the speaker.

In the initial stage for designing the case 10 of the earphone device according to the prior art, a volume of the bass tube 12 is determined according to specific consumer groups. However, the low-frequency characteristics of the earphone device are primarily determined by the volume of the bass tube 12. Here, the low frequency refers to frequencies in a range from 20 Hz to 200 Hz, which is further divided into low bass, mid bass, and upper bass. The frequency range of the low bass is 20 HZ to 40 Hz, the frequency range of the mid bass is 40 Hz to 100 Hz, and the frequency range of the upper bass is 100 Hz to 200 Hz. Therefore, consumers who often listen to classical music pay special attention to the low bass performance, while consumers who often listen to dance music with strong beats care more about the upper bass performance.

Currently, various music players have a very large storage capacity, and can store hundreds of or even thousands of songs. For a consumer who does not have specific favorite music styles, many different styles of songs may be stored in the music player, and the songs require different bass performances. Therefore, if an earphone device similar to that in the prior art is used for converting and outputting the sounds, the tone quality performance is more or less unsatisfactory for users.

SUMMARY OF THE INVENTION

In view of the above, the present invention is directed to an earphone device with a bass adjusting function, which enables a user to adjust bass characteristics as desired, so as to fully express the intrinsic tone quality characteristics of music.

To achieve the above objective, the present invention provides an earphone device with a bass adjusting function, which includes a case and a control unit. An accommodating portion at one end of the case has an inner chamber for accommodating a speaker, and an extension segment at the other end of the case is hollow-shaped and is in communication with the inner chamber, so as to form a back chamber of the speaker. The control unit is disposed on the extension segment. When the control unit is located at a first position, the extension segment is divided into a first space and a second space therein, and the first space is in communication with the inner chamber of the accommodating portion. When the control unit changes to a second position, the first space is in communication with the second space, so as to increase a volume of the back chamber of the speaker.

To achieve the above objective, the present invention further provides an earphone device with a bass adjusting function, which includes a case and an adjusting tube. An accommodating portion is disposed at one end of the case for accommodating a speaker, and an extension tube is disposed at the other end of the case. The extension tube has a first space, a first combining portion is disposed at an end of the extension tube, and at least one through hole is disposed on the first combining portion. The adjusting tube has a second space. A second combining portion is disposed on the adjusting tube corresponding to the extension tube. The second combining portion is combined with the first combining portion. A through hole is disposed on the second combining portion. When the adjusting tube rotates from a first position to a second position, the through hole of the second combining portion is corresponding to the through hole of the first combining portion, such that the first space is in communication with the second space.

Based on the above, the earphone device with a bass adjusting function according to the present invention has a first space and a second space, and by rotating or sliding the control unit disposed on the extension segment or rotating the adjusting tube combined with the extension tube, the first space is controlled to be in communication with or not in communication with the second space. Thus, a volume of the bass tube formed by the extension segment or formed by the extension tube combined with the adjusting tube can be adjusted. When the first space is in communication with the second space, the bass tube has the largest volume, so that the low bass performance is better. When the first space is not in communication with the second space, the bass tube only has the first space in communication with the inner chamber of the accommodating portion of the earphone device, and at this time, the upper bass performance is better. Therefore, the present invention enables the user to adjust the bass performance according to different music styles or personal favorites, provides diversified changes, and enhances the pleasure in operating the device.

DETAILED DESCRIPTION OF THE INVENTION

The earphone device with a bass adjusting function according to the embodiments of the present invention is illustrated below with reference to the accompanying drawings.

Figure 1:
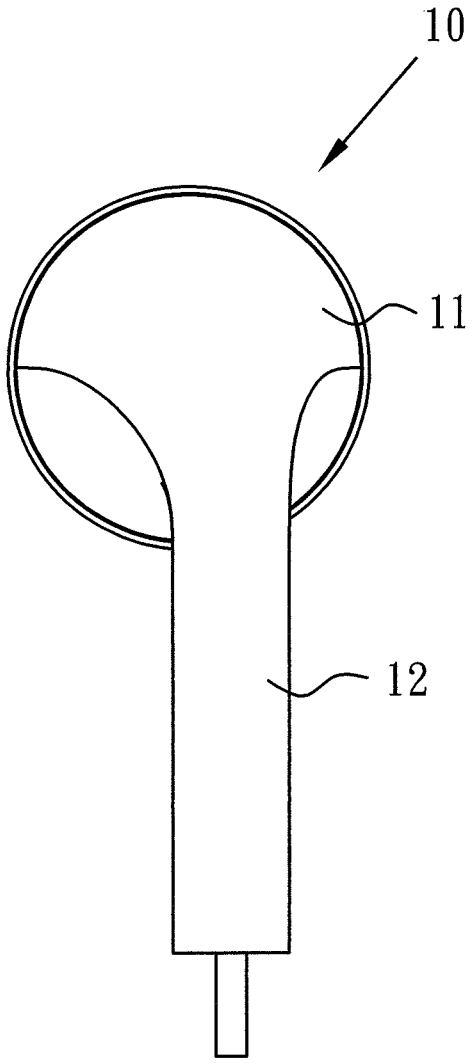
FIG. 1 (PRIOR ART)
FIG. 1 is a schematic view of an earphone device according to the prior art.
Figure 2:
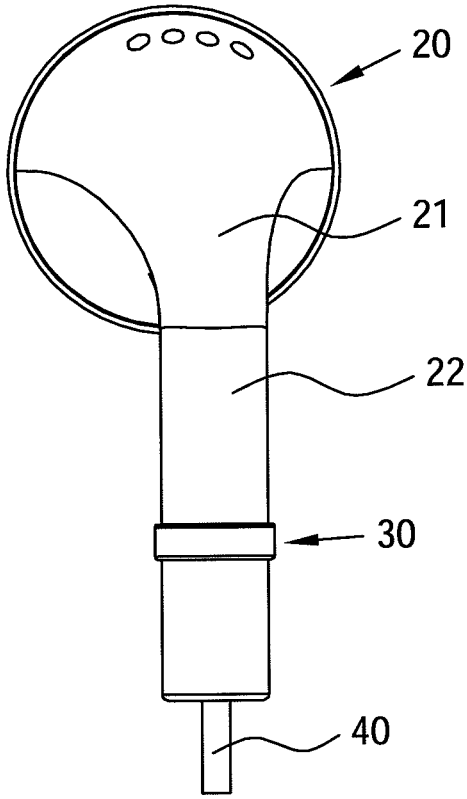
FIG. 2 is a schematic assembled view of an earphone device according to a first embodiment of the present invention.
Figure 3:
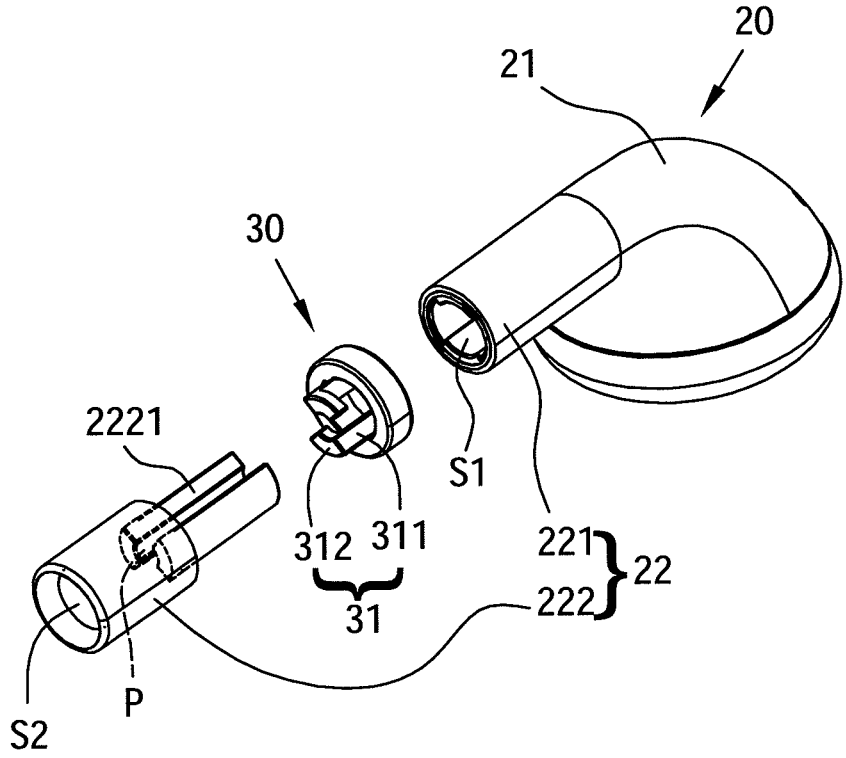
FIG. 3 is a schematic exploded view of the earphone device according to the first embodiment of the present invention.

FIGS. 2 and 3 are a schematic assembled view and a schematic exploded view of an earphone device with a bass adjusting function according to a first embodiment of the present invention respectively. As shown in FIGS. 2 and 3, the earphone device includes a case 20 and a control unit 30. The case 20 includes an accommodating portion 21 and an extension segment 22. The accommodating portion 21 has an inner chamber for accommodating a speaker, and the extension segment 22 is hollow-shaped and is in communication with the inner chamber of the accommodating portion 21. The extension segment 22 and the inner chamber of the accommodating portion 21 together form a back chamber of the speaker. In addition, the control unit 30 is rotatably or movably disposed on the extension segment 22 and is used for controlling a volume of the back chamber of the speaker. Besides the above components, the earphone device further includes a transmission wire 40, which passes through the extension segment 22. One end of the transmission wire 40 is electrically connected to the speaker in the earphone device, and the other end extends to and is electrically connected to a corresponding electronic device, for example, a mobile phone or a music player.

Referring to FIGS. 3, 4A, 4B, 5A, and 5B together, in this embodiment, the extension segment 22 is formed by an extension tube 221 and an adjusting tube 222. The extension tube 221 extends from an accommodating portion 21, and the adjusting tube 222 is combined with the extension tube 221. The interior of the extension tube 221 is defined as a first space S1, and the interior of the adjusting tube 222 is defined as a second space S2.

Figure 4A:
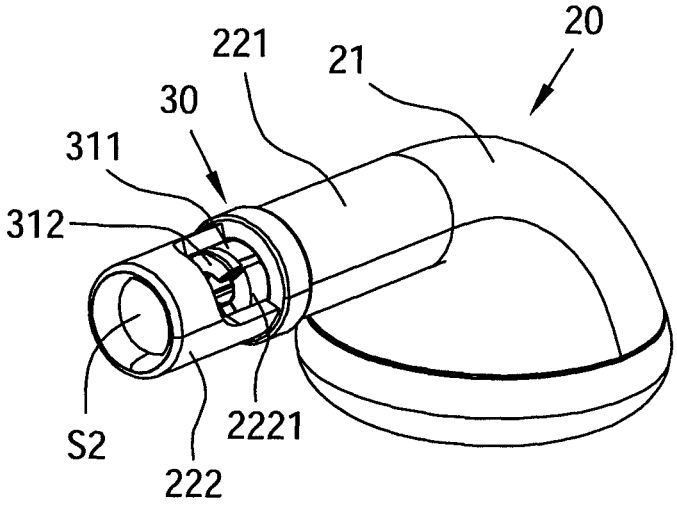
FIG. 4A is a schematic view (I) of the earphone device adjusted to a closed state according to the first embodiment of the present invention.
Figure 4B:
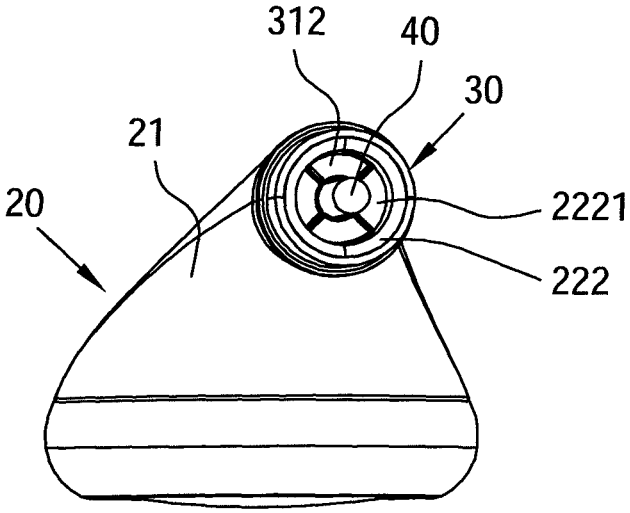
FIG. 4B is a schematic view (II) of the earphone device adjusted to a closed state according to the first embodiment of the present invention.
Figure 5A:
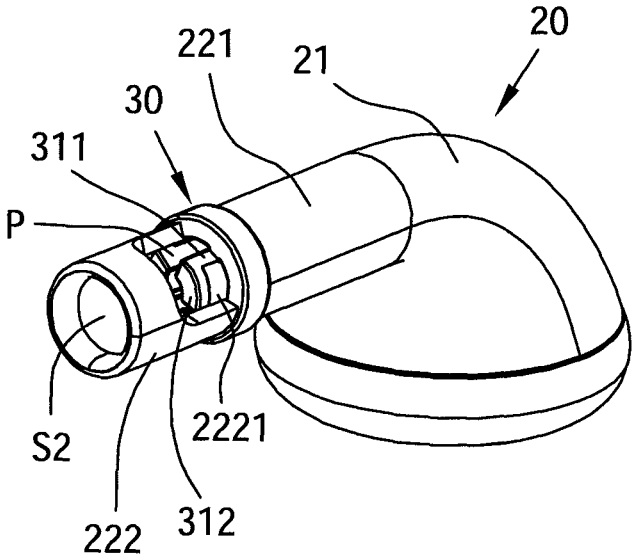
FIG. 5A is a schematic view (I) of the earphone device adjusted to a communication state according to the first embodiment of the present invention.
Figure 5B:
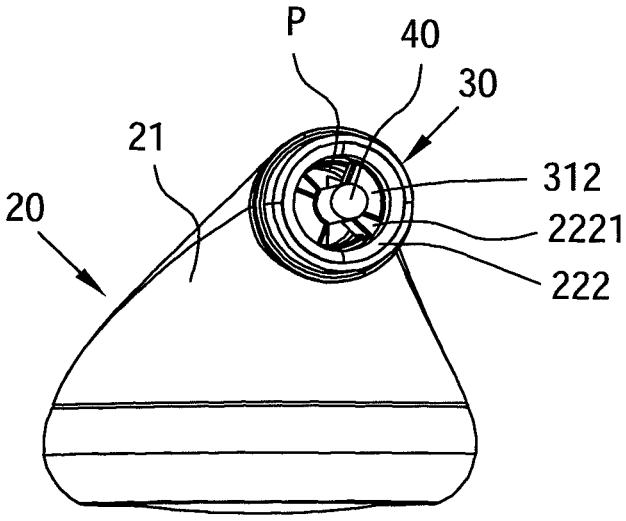
FIG. 5B is a schematic view (II) of the earphone device adjusted to a communication state according to the first embodiment of the present invention.

The adjusting tube 222 has two arms 2221, which are inserted into the extension tube 221. A part of the two arms 2221 is exposed outside the tube, and the other part of the two arms 2221 is located inside the tube. The adjusting tube 222 is positioned and combined with the extension tube 221 through the two arms 2221. The control unit 30 is a ring, and two baffle blocks 31 protrude from the control unit 30 in an axial direction. When the control unit 30 is sleeved on the two arms 2221 and is rotated to a first position with respect to the two arms 2221 (as shown in FIG. 4A), the two baffle blocks 31 block a path P between the two arms 2221, such that the first space S1 is not in communication with the second space S2 (as shown in FIG. 4B), and at this time, the earphone device is in a closed state. When the control unit 30 is rotated to a second position with respect to the two arms 2221 (as shown in FIG. 5A), the two baffle blocks 31 do not block the path P any more, such that the first space S1 is in communication with the second space S2 (as shown in FIG. 5B), and at this time, the earphone device is in a communication state.

The baffle block 31 of the control unit 30 is formed by an extension portion 311 and a block portion 312. When the control unit 30 is sleeved on the two arms 2221, the extension portion 311 is inserted into the path P, and the block portion 312 extends transversely along bottom edges of the two arms 2221 from an end of the extension portion 311. As shown in FIGS. 4A and 4B, the control unit 30 blocks the path P by using the block portion 312. As shown in FIGS. 5A and 5B, the block portion 312 moves to the bottom edges of the two arms 2221.

The extension segment 22 formed by combining the extension tube 221 with the adjusting tube 222 is a structure for enhancing the bass performance in the earphone device. The extension segment 22 and the inner chamber of the accommodating portion 21 together form the back chamber of the speaker, and a part of the extension segment 22 may also be referred to as a bass tube. In this embodiment, the control unit 30 is rotated between the first position and the second position, so as to control the second space S2 of the adjusting tube 222 to be in communication with or not in communication with the first space S1 of the extension tube 221. As described above, a volume of the bass tube is a factor for affecting the low-frequency characteristics of the earphone device. Therefore, when the second space S2 is in communication with the first space S1, the bass tube has the largest volume, and the low bass performance is better. On the contrary, when the second space S2 is not in communication with the first space S1, the bass tube only has the first space S1 in the extension tube 221 to be in communication with the inner chamber of the accommodating portion, and at this time, the upper bass performance is better.

In this embodiment, the extension segment 22 is formed by two separate components, that is, the extension tube 221 and the adjusting tube 222. However, the extension segment 22 may also be a structure integrally extending from the case 20. Particularly, as long as the control unit 30 is designed to be sleeved on the extension segment 22, and is rotated or slides between the first position and the second position to control the first space S1 to be in communication with or not in communication with the second space S2, the structure can also achieve the same efficacy as that in the first embodiment.

Figure 6A:
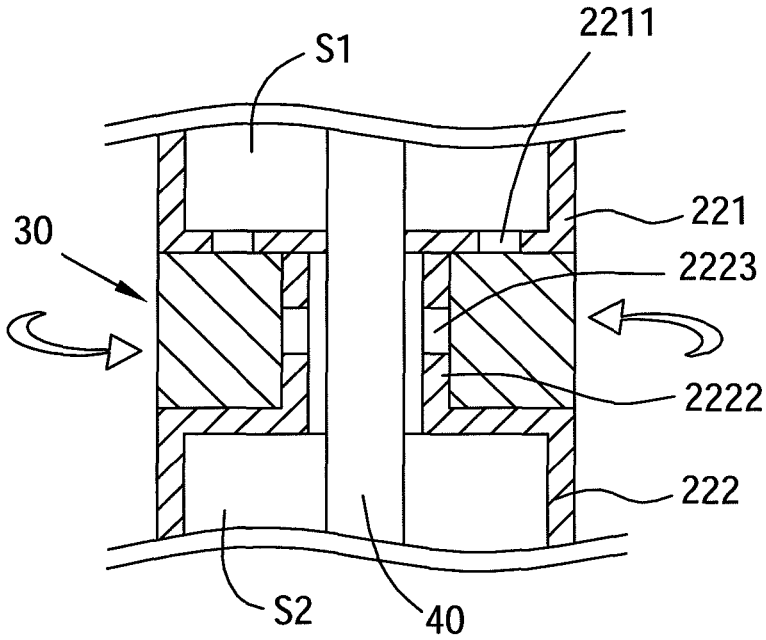
FIG. 6A is a schematic view of an earphone device adjusted to a closed state according to a second embodiment of the present invention.
Figure 6B:
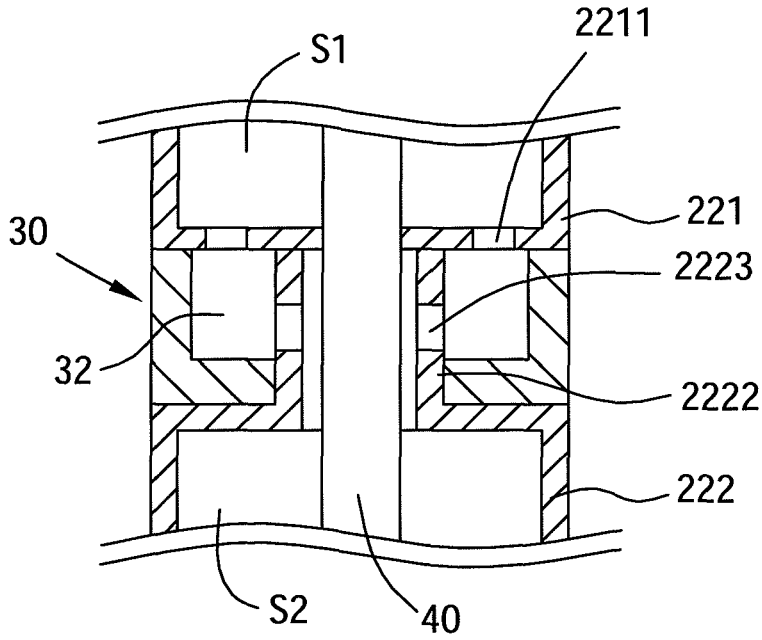
FIG. 6B is a schematic view of the earphone device adjusted to a communication state according to the second embodiment of the present invention.

FIGS. 6A and 6B are schematic views of an earphone device adjusted to a closed state and adjusted to a communication state according to a second embodiment of the present invention respectively. The main difference between the earphone device shown in FIGS. 6A and 6B and that of the first embodiment is that, two through holes 2211 are opened at a bottom edge of the extension tube 221, and the structure of the adjusting tube 222 is designed as having a pillar 2222 at a front end. When the adjusting tube 222 is combined with the extension tube 221, the control unit 30 is sleeved on the pillar 2222. In addition, two through holes 2223 are further disposed on the pillar 2222.

In this embodiment, the control unit 30 has two grooves 32. When the control unit 30 is located at a first position as shown in FIG. 6A, the control unit 30 blocks the through holes 2211 of the extension tube 221 and the though holes 2223 of the adjusting tube 222 at the same time. At this time, the earphone device is in a closed state. Moreover, when the control unit 30 is rotated to a second position as shown in FIG. 6B, the grooves 32 of the control unit 30 move to positions corresponding to the through holes 2211 and the through holes 2223 at the same time, such that the first space S1 is in communication with the second space S2 via the through holes 2211, the grooves 32, and the through holes 2223.

In the above drawings and description, though the through holes 2211, the grooves 32, and the through holes 2223 are all configured as two groups correspondingly, the efficacy of controlling the closed or communication state between the first space S1 and the second space S2 can also be achieved by using only one group of the above components respectively, which is not described repeatedly with reference to the drawings herein.

Figure 7A:
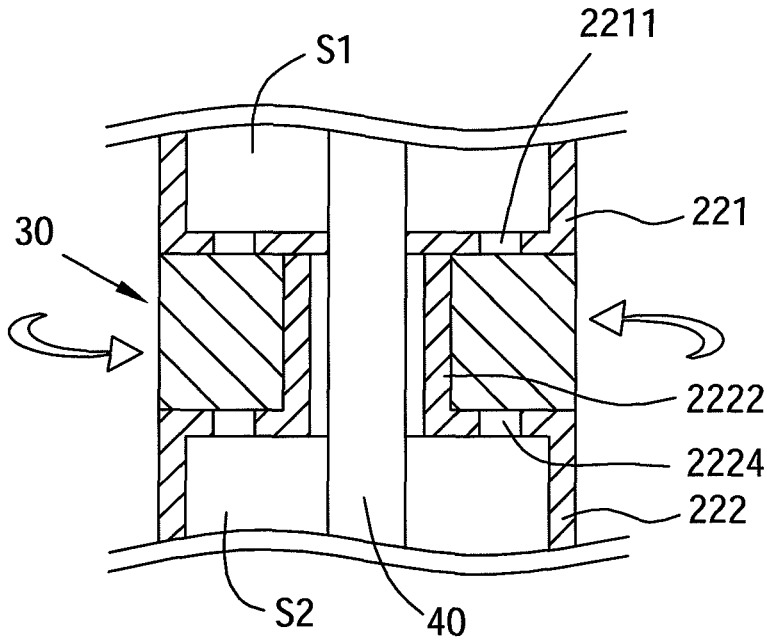
FIG. 7A is a schematic view of an earphone device adjusted to a closed state according to a third embodiment of the present invention.
Figure 7B:
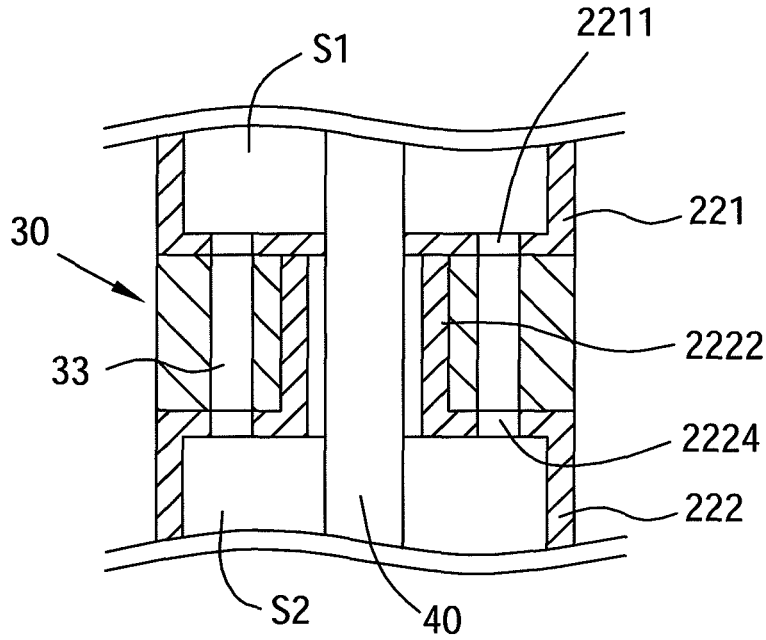
FIG. 7B is a schematic view of the earphone device adjusted to a communication state according to the third embodiment of the present invention.

FIGS. 7A and 7B are schematic views of an earphone device adjusted to a closed state and adjusted to a communication state according to a third embodiment of the present invention respectively. The main difference between the earphone device shown in FIGS. 7A and 7B and that of the second embodiment is that, through holes 2224 of the adjusting tube 222 are disposed at a shoulder position near the pillar 2222 in this embodiment, and the through holes 2224 are corresponding to the through holes 2211 of the extension tube 221 and are disposed on the same axial line correspondingly. Therefore, in this embodiment, two axial paths 33 pass through the control unit 30. When the control unit 30 is located at a first position as shown in FIG. 7A, the control unit 30 blocks the through holes 2211 of the extension tube 221 and the through holes 2224 of the adjusting tube 222 at the same time. At this time, the earphone device is in a close state. Moreover, when the control unit 30 is rotated to a second position as shown in FIG. 7B, the paths 33 of the control unit 30 are rotated to positions corresponding to the through holes 2211 and the through holes 2224 at the same time, such that the first space S1 is in communication with the second space S2 via the through holes 2211, the paths 33, and the through holes 2224.

In the drawings and description of the third embodiment, though the through holes 2211, the paths 33, and the through holes 2224 are all configured as two groups correspondingly, the efficacy of controlling the closed or communication state between the first space S1 and the second space S2 can also be achieved by using only one group of the above components respectively, which is not described repeatedly with reference to the drawings herein.

It should be noted that, in the second and third embodiments, the extension segment 22 of the earphone device may be formed by two separate components or be a structure integrally extended from the case 20, and such modification to the structure does not affect the efficacy of the present invention, and will not be described again herein.

Figure 8A:
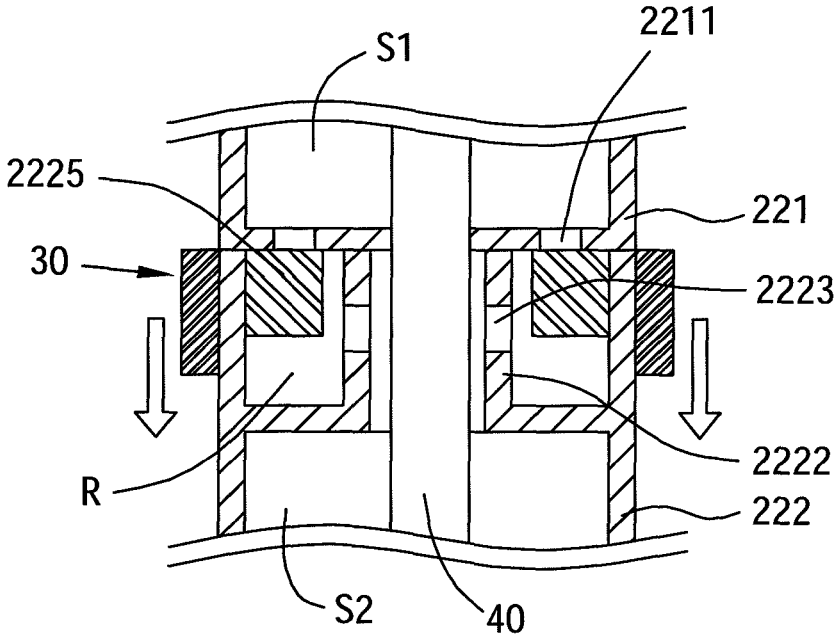
FIG. 8A is a schematic view of an earphone device adjusted to a closed state according to a fourth embodiment of the present invention.
Figure 8B:
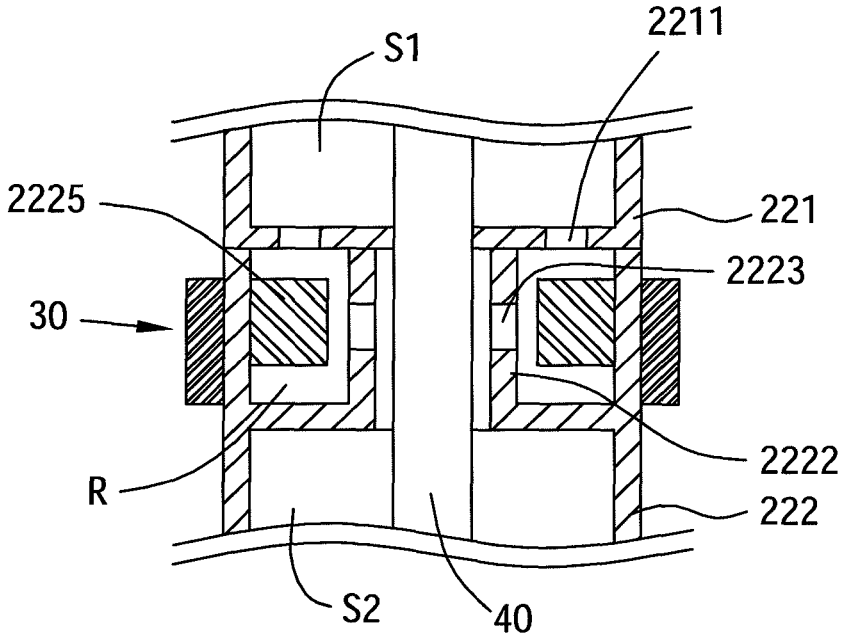
FIG. 8B is a schematic view of the earphone device adjusted to a communication state according to the fourth embodiment of the present invention.

FIGS. 8A and 8B are schematic views of an earphone device adjusted to a closed state and adjusted to a communication state according to a fourth embodiment of the present invention respectively. The main difference between the earphone device shown in FIGS. 8A and 8B and that of the second embodiment is that, an accommodating room R is recessed at a front end of the adjusting tube 222. The accommodating room R is in communication with the first space S1 via the through holes 2211, and is in communication with the second space S2 via the through holes 2223. A baffle block 2225 is further disposed inside the accommodating room R. One of the baffle block 2225 and a ring-shaped control unit 30 is made of a magnetic material, and the other one is made of a metal material. When the control unit 30 is located at a first position as shown in FIG. 8A, the baffle block 2225 blocks the through holes 2211 of the extension tube 221. At this time, the earphone device is in a closed state. Moreover, when the control unit 30 slides to a second position as shown in FIG. 8B, the baffle block 2225 and the control unit 30 are attracted by each other, so that the baffle block 2225 is driven to move together, and accordingly, the through holes 2211 are not blocked any more. At this time, the earphone device is in a communication state, and the first space S1 is in communication with the second space S2 via the through holes 2211, the accommodating room R, and the through holes 2223.

Figure 9A:
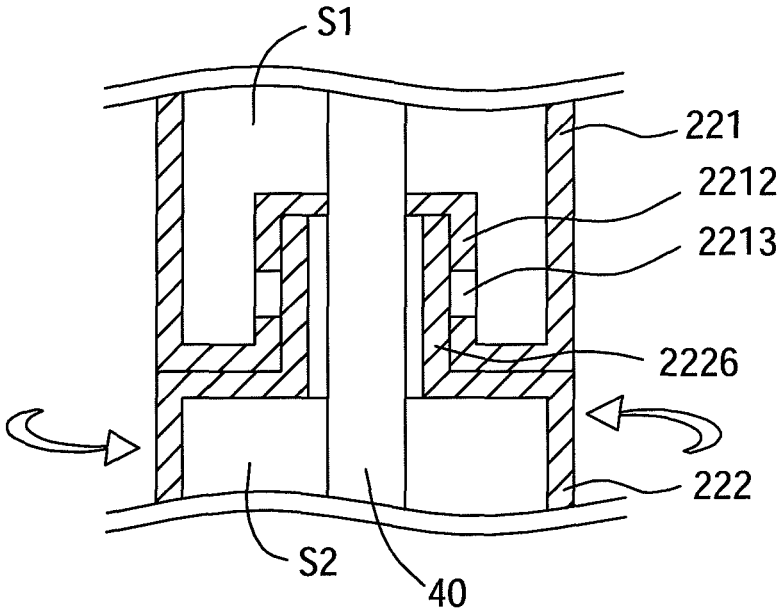
FIG. 9A is a schematic view of an earphone device adjusted to a closed state according to a fifth embodiment of the present invention.
Figure 9B:
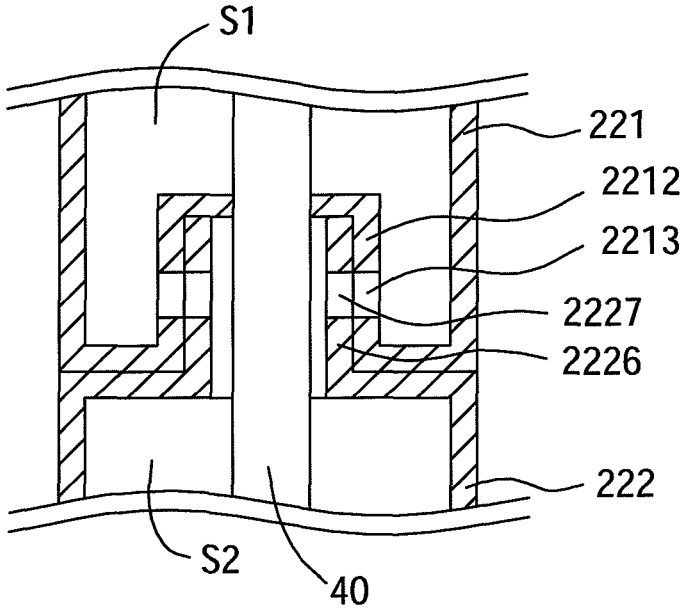
FIG. 9B is a schematic view of the earphone device adjusted to a communication state according to the fifth embodiment of the present invention.

FIGS. 9A and 9B are schematic views of an earphone device adjusted to a closed state and adjusted to a communication state according to a fifth embodiment of the present invention respectively. The main difference between the earphone device shown in FIGS. 9A and 9B and that of the first embodiment is that, the adjusting tube 222 is used to directly replace the control unit 30 in the above embodiments. In this embodiment, the extension tube 221 extends from the accommodating portion (not shown), and a first combining portion 2212 is disposed at an end of the extension tube 221, which is implemented as a recess with respect to a bottom edge of the extension tube 221. Two through holes 2213 are disposed on the first combining portion 2212. In addition, corresponding to the extension tube 221, a second combining portion 2226 is also disposed on the adjusting tube 222, which is implemented as a pillar. In addition, through holes 2227 are also disposed on the second combining portion 2226.

When the adjusting tube 222 is located at a first position as shown in FIG. 9A, the through holes 2227 of the adjusting tube 222 are not aligned with the through holes 2213 of the extension tube 221, so that the first space S1 is not in communication with the second space S2. At this time, the earphone device is in a closed state. When the adjusting tube 222 is rotated to a second position as shown in FIG. 9B, the through holes 2227 of the adjusting tube 222 are rotated to positions corresponding to the through holes 2213 of the extension tube 221. At this time, the earphone device is in a communication state, and the first space S1 is in communication with the second space S2 via the through holes 2213 and the through holes 2227.

In the earphone device according to the fifth embodiment, the first combining portion 2212 may be configured as a pillar, and the second combining portion 2226 may be correspondingly configured as a recess. Such replacement does not affect the efficacy of controlling the first space S1 to be in communication with or not in communication with the second space S2 by rotating the adjusting tube 222, which will not be described again with reference to the drawings herein.

As described above, the earphone device with a bass adjusting function according to the present invention includes an inner chamber, a first space, and a second space. By rotating or sliding the control unit disposed on the extension segment or the adjusting tube combined with the extension tube, the efficacy of controlling the first space to be in communication with or not in communication with the second space can be achieved. When the second space is in communication with the first space, the volume of the bass tube formed by the extension segment or formed by the extension tube combined with the adjusting tube is the largest, and the low bass performance is better. When the second space is not in communication with the first space, the bass tube only has the first space in communication with the inner chamber of the accommodating portion of the earphone device, and at this time, the upper bass performance is better. Therefore, the earphone device of the present invention enables the user to adjust the bass performance according to different music styles or personal favorites, provides diversified changes, and enhances the pleasure in operating the device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An earphone device with a bass adjusting function, comprising:

an accommodating portion, having an inner chamber for accommodating a speaker;

an extension segment which is hollow-shaped and has a first space and a second space therein, and the first space is in communication with the inner chamber of the accommodating portion, and when a portion of the extension segment is adjusted from a first position to a second position, the first space, the second space, and the inner chamber of the accommodating portion are in communication.

2. The earphone device with a bass adjusting function according to claim 1, wherein the accommodating portion and the extension segment are disposed on a case and the extension segment has a control unit, and when the control unit is located at the first position, the first space and the second space are blocked by the control unit and the first space is in communication with the inner chamber of the accommodating portion.

3. The earphone device with a bass adjusting function according to claim 2, wherein the extension segment comprises an extension tube and an adjusting tube, the extension tube extends from the accommodating portion, the adjusting tube is combined with the extension tube, and when the control unit is located at the first position between the extension tube and the adjusting tube, the first space is formed inside the extension tube, and the second space is formed inside the adjusting tube.

4. The earphone device with a bass adjusting function according to claim 3, wherein the control unit is rotatably adjusted with respect to the extension segment.

5. The earphone device with a bass adjusting function according to claim 4, wherein the adjusting tube has two arms inserted into the extension tube, two baffle blocks protrude from the control unit in an axial direction, the control unit is sleeved on the two arms, when the control unit is rotated to the first position with respect to the two arms, the two baffle blocks block a path between the two arms, such that the first space is not in communication with the second space, and when the control unit is rotated to the second position, the two baffle blocks do not block the path.

6. The earphone device with a bass adjusting function according to claim 5, wherein each of the two baffle blocks has an extension portion and a block portion, when the control unit is sleeved on the two arms, the extension portions are inserted in the path, and the block portions extend transversely along bottom edges of the two arms from an end of the extension portions, when the control unit is located at the first position, the block portions block the path between the two arms, and when the control unit is located at the second position, the block portions move to the bottom edges of the two arms.

7. The earphone device with a bass adjusting function according to claim 4, wherein at least one through hole is disposed on the extension tube and the adjusting tube respectively, the control unit has a groove, when the control unit is rotated from the first position to the second position, the groove is in communication with the through holes of the extension tube and the adjusting tube.

8. The earphone device with a bass adjusting function according to claim 7, wherein a pillar is disposed on the adjusting tube, the through hole is formed at a periphery of the pillar, and the through hole of the extension tube is formed at a bottom edge of the extension tube.

9. The earphone device with a bass adjusting function according to claim 4, wherein at least one through hole is disposed on the extension tube and the adjusting tube respectively, the control unit has a path, when the control unit is located at the first position, the path is not in communication with the through holes, and when the control unit is rotated to the second position, the path is in communication with the through holes of the extension tube and the adjusting tube.

10. The earphone device with a bass adjusting function according to claim 9, wherein the through hole is formed at a bottom edge of the extension tube, the adjusting tube has a pillar, and the through hole is formed at a shoulder portion near the pillar corresponding to the through hole of the extension tube, and the path of the control unit is disposed in an axial direction, and is in communication with the through hole of the extension tube and the through hole of the adjusting tube.

11. The earphone device with a bass adjusting function according to claim 3, wherein the control unit slides with respect to the extension tube or the adjusting tube, so as to perform adjustment.

12. The earphone device with a bass adjusting function according to claim 11, wherein at least one through hole is disposed on the extension tube and the adjusting tube respectively, a baffle block and the control unit are disposed inside and outside the adjusting tube respectively, a magnetic attraction force exists between the control unit and the baffle block, when the control unit is located at the first position, the baffle block blocks the through hole of the extension tube or the through hole of the adjusting tube, and when the control unit slides to the second position, the baffle block does not block any one of the through holes.

13. The earphone device with a bass adjusting function according to claim 12, wherein the control unit is a ring, one of the baffle blocks and the ring is made of a magnetic material, and the other one is made of metal.

14. The earphone device with a bass adjusting function according to claim 13, wherein the first combining portion is a recess with respect to a bottom edge of the extension tube, the second combining portion is a pillar combined with the recess, and the through holes are respectively formed on the recess and the pillar.

15. The earphone device with a bass adjusting function according to claim 13, wherein the first combining portion is a pillar with respect to a bottom edge of the extension tube, the second combining portion is a recess combined with the pillar, and the through holes are respectively formed on the recess and the pillar.

16. The earphone device with a bass adjusting function according to claim 1, wherein the accommodating portion and the extension segment are disposed on a case and the extension segment comprises an extension tube and an adjusting tube, the extension tube extends from the accommodating portion, the adjusting tube is combined with the extension tube, the first space is formed inside the extension tube, the first space is in communication with the inner chamber, a first combining portion is disposed at an end of the extension tube, and at least one through hole is disposed on the first combining portion and is in communication with the inner chamber, and the second space is disposed on the adjusting tube, wherein a second combining portion is disposed on the adjusting tube corresponding to the extension tube, the second combining portion is combined with the first combining portion, at least one through hole is disposed on the second combining portion, and when the adjusting tube is adjusted from a first position to a second position, the through hole of the second combining portion is in communication with the through hole of the first combining portion, such that the first space is in communication with the second space.

* * * * *